United States Patent [19]

Sommer

[11] Patent Number: 4,651,672

[45] Date of Patent: Mar. 24, 1987

[54] DEVICE FOR COATING CONTINUOUS WEBS

[75] Inventor: Herbert Sommer, Dusseldorf, Fed. Rep. of Germany

[73] Assignee: Jagenberg AG, Dusseldorf, Fed. Rep. of Germany

[21] Appl. No.: 554,490

[22] Filed: Nov. 23, 1983

[30] Foreign Application Priority Data

Nov. 23, 1982 [DE] Fed. Rep. of Germany ..... 3243317
Oct. 21, 1983 [DE] Fed. Rep. of Germany ..... 3338323

[51] Int. Cl.[4] ..... B05C 11/04
[52] U.S. Cl. ..... 118/126; 118/261
[58] Field of Search ..... 118/126, 119, 122, 123, 118/261

[56] References Cited

U.S. PATENT DOCUMENTS

| | | | |
|---|---|---|---|
| 343,345 | 6/1986 | Sparks | 118/122 X |
| 1,312,034 | 8/1919 | Jones | 118/126 |
| 3,029,779 | 4/1962 | Hornbostel | 118/119 X |
| 3,450,098 | 6/1969 | Williams, Jr. | 118/126 |
| 3,882,817 | 5/1975 | Zink | 118/126 |
| 4,259,379 | 3/1981 | Britton | 118/126 X |
| 4,458,376 | 7/1984 | Sitko | 118/126 X |

*Primary Examiner*—John P. McIntosh
*Attorney, Agent, or Firm*—Sprung, Horn, Kramer & Woods

[57] ABSTRACT

A device for coating continuous webs with regulable coating strength by means of a doctor rod that rests against the coated side of the web, that is mounted in a doctor bed, and that can be elastically forced with regulable pressure against the web being coated. The doctor rod is a doctor batten that moves with little friction along at least one overflow-side slide face of a rigid doctor bed. The face of the doctor batten toward the web that is being coated is rectangular and demarcates in conjunction with the web a narrowing coating-material application gap with a geometry that depends on the degree of contact pressure. The upper edge of the face constitutes a straight and sharp stripping edge. The face and stripping edge of the doctor batten are flexible. Its face is highly resistant to wear. The contact pressure is exerted by an inflatable means of exerting pressure positioned between the batten and the bed.

22 Claims, 7 Drawing Figures

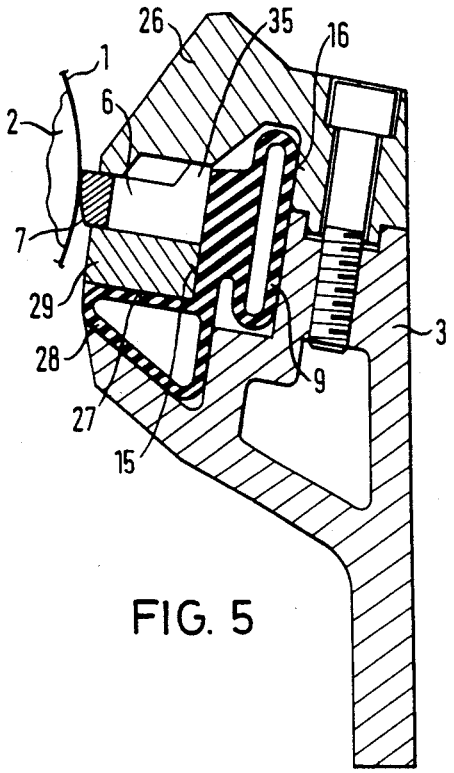
FIG. 5
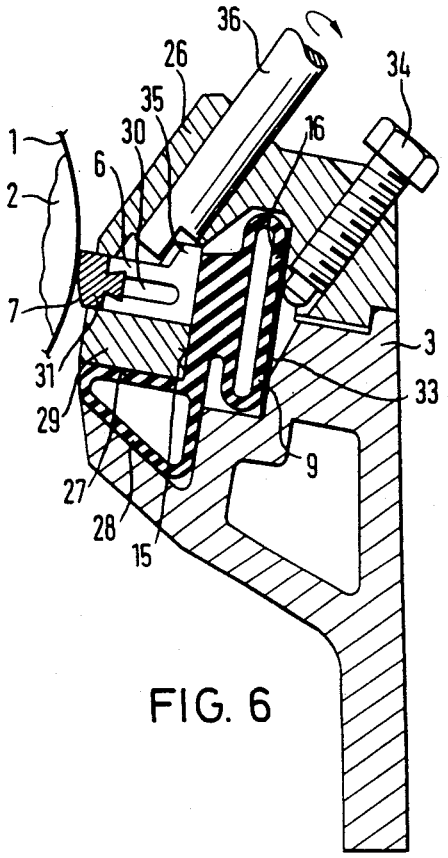
FIG. 6
FIG. 7
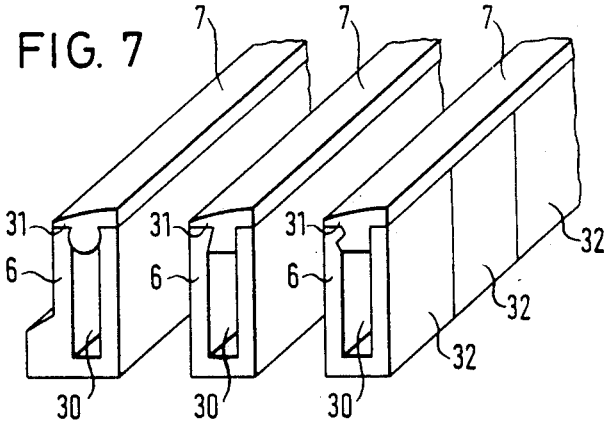

DEVICE FOR COATING CONTINUOUS WEBS

BACKGROUND OF THE INVENTION

The present invention relates to a device for coating continuous webs with regulable coating strength by means of a doctor rod that rests against the coated side of the web, that is mounted in a doctor bed, and that can be elastically forced with regulable pressure against the web being coated.

The doctor rod in known devices of this type (e.g. German Offenlegungsschrift Pat. No. 3,022,955) is a metering rod mounted in an elastic doctor bed. Between the doctor bed and the bed of the machine is a means of exerting pressure, a compressed-air charged contact-pressure hose for example, that forces the metering rod with variable pressure against the web being coated to control the coating strength and hence the rate at which the coating material flows. Although a metering rod does result in a narrowing coating gap of constant geometry for the coating material, an expanding gap also occurs on the exit side that can lead to surface irregularities in the coating.

SUMMARY OF THE INVENTION

The object of the present invention is a device of the aforesaid type that provides a simple means of precisely varying the coating weight while maintaining highest-quality coating.

This object is attained in accordance with the invention in a device of the aforesaid type wherein (a) the doctor rod is a doctor batten that moves with little friction along at least one overflow-side slide face of a rigid doctor bed, (b) the face of the doctor batten toward the web that is being coated is rectangular and demarcates in conjunction with the web a narrowing coating-material application gap with a geometry that depends on the degree of contact pressure, (c) the upper edge of the face constitutes a straight and sharp stripping edge, (d) the face and stripping edge of the doctor batten are flexible, (e) its face is highly resistant to wear, (f) the contact pressure is exerted by an elastic means of exerting pressure positioned between the batten and the bed.

A doctor batten that moves with little friction allows extremely accurate control of the force with which the coating material is applied because the inflatable means of exerting contact pressure acts on the flexible face and stripping edge of the doctor batten. This results in extremely uniform coating of the web. Hydrodynamic pressure is generated in the (wedge-shaped) coating gap between the geometrically stable face of the doctor batten and the web, leading to equilibrium in relation to the force of the inflatable means of exerting contact pressure. The sharp stripping edge at the overflow edge of the face of the doctor batten ensures a high level of smoothness, whereas the face's high resistance to wear, as demonstrated by a high Vickers hardness etc., ensures long life no matter how high the contact pressure. A doctor batten shaped and mounted at the flow-regulating lip as in the invention makes redundant additional mechanisms for adjusting the contour of the doctor batten to irregularities in the back-up roll that the web travels over or along the coating width of the web.

The doctor batten can travel with low friction between parallel slide faces on the doctor bed.

It is practical for the coefficient of friction between the doctor batten and bed to be about $\mu \leqq 0.1$. This keeps the friction of the batten and the doctor holder negligibly low in comparison with the contact pressure exerted by the batten on the coated web.

It is practical for the doctor batten or bed, at least in the vicinity of the slide faces, to be made out of steel, special steel, or coated aluminum and for the bed or batten, at least in the vicinity of the slide faces, to be made out of gunmetal that is either coated with Teflon or solid nickel or hard-anode oxidized. Such pairs of material lead to the desired coefficient of friction.

It is practical for the face of the doctor batten to extend at the stripping edge at more or less of a tangent to the coated web and to curve concavely as it extends from the stripping edge at least in the vicinity of that edge with a radius such that 4 mm $\leqq R \leqq 00$, preferably 5 mm $\leqq R \leqq 250$ mm, and even more preferably 20 mm $\leqq R \leqq 50$ mm. The curvature should be selected in accordance with the intended range of coating weight and the rheological properties of the coating material.

It is practical for the face to be facet ground to approximately the radius of curvature, which is an especially simple way of shaping the face in any way desired.

It is practical for the face to be between 8 mm and 60 mm wide. The width of the face is determined by the coating weight. The higher the coating weight the lower the hydrodynamic pressure and the wider the face and hence the longer the wedge-shaped gap and the more acute the angle of the wedge in order to obtain a stable equilibrium.

To facilitate the use of doctor battens with faces that vary in width it is practical to position a spacer between the upstream surface of the doctor batten and bed.

The stripping edge of the doctor batten can be relief ground to improve its action even more.

To obtain the desired doctor-batten flexibility it is practical for it to have a moment of inertia I in the vicinity of the face and the stripping edge in relation to an axis perpendicular to the edge and parallel to the web being coated such that 200 $mm^4 \leqq I \leqq 7000$ $mm^4$. This moment of inertia can be obtained with equidistant incisions or equidistant incisions and recesses along the length of the doctor batten.

The doctor batten can alternatively be made of polytetrafluoroethylene, in which case no incisions are necessary. The doctor batten can also be made out of a rubber-elastic material and the face have an antifriction insert or mount.

To protect the doctor batten from wear it is practical for the Vickers hardness of its face to be greater than 600 HV. It is practical for the face of the doctor batten to be chromed, surface- or insert-hardened, spray-coated with oxide ceramics, anodized, or, if aluminum, hard coated or solid nickled. The face of the doctor batten in one practical embodiment can also consist of an inlay with high wear resistance.

It is also practical for the bottom of the doctor batten to have a longitudinal recess in the vicinity of the face, forming a labyrinth seal for the doctor holder to prevent coating material from penetrating into its guides.

It is practical for the inflatable means of exerting contact pressure, preferably a contact-pressure hose, to operate between a surface of the doctor batten that is essentially perpendicular to the overflow-side slide face and another surface of the batten that is essentially parallel to the first surface.

In one preferred embodiment the means of exerting contact pressure and the doctor batten can be in one piece.

It is also practical for an inflatable means of exerting sealing pressure, preferably a sealing-pressure hose, to be positioned between the upstream surface of the doctor batten and the doctor bed. This second inflatable means of exerting pressure both prevents coating material from getting between the doctor holder and the doctor batten and enables the equilibrium obtained between the hydrodynamic pressure and the pressure in the first means of exerting pressure to be maintained by increasing the pressure in the second means of exerting pressure.

It is practical for the second means of exerting pressure and the doctor batten to be in one piece.

It is practical for the back-up roll to have a rubber-elastic surface with a hardness preferably between 60≦Shore A≦95.

When webs are to be coated on both sides with different coats, two doctor battens can be positioned with the faces opposing each other with different radii of curvature. The different radii can be selected to obtain a fixed coating-weight ratio on both sides. In this case, obviously, a back-up roll to advance the web through the coating area will be neither necessary nor present. The coating weight will be the same on each side if the radii are equal.

Supplementary means of exerting contact pressure can be positioned behind the initial means to locally elevate pressure and compensate for irregular uptake of coating material by the web. It is practical for these means to be set screws that engage a sheet-steel backing in the doctor bed.

It will also be an advantage if the doctor batten has a longitudinal slot opening toward the web with an inlay that snaps into the open end and constitutes the face. A doctor batten with a longitudinal slot can also be longitudinally divided into several individually movable retaining blocks.

Finally, it is practical to facilitate removing any contamination between the doctor batten and the web that could make lines, especially continuous, on the web by providing means of partly forcing the doctor batten down. It will be an advantage if these means are keys that can be inserted into the doctor bed and engage a lateral continuation of the doctor batten.

Some preferred embodiments of the invention will now be described with reference to the attached drawings, wherein

BRIEF DESCRIPTION OF THE DRAWINGS

FIGS. 5 and 6 are schematic partial views, partly in section, of modifications of the device in accordance with the invention, and FIG. 7 illustrates partial perspective views of modified doctor battens.

DETAILED DESCRIPTION OF THE PREFERRED EMBODIMENTS

Figure 1:
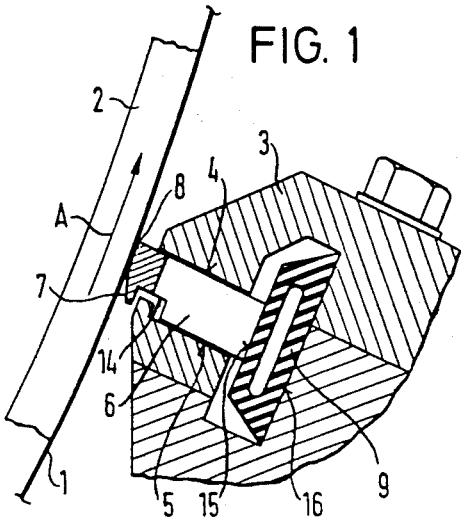
FIG. 1 is a schematic partial view in section of a device in accordance with the invention.

In the device illustrated in FIG. 1 a web 1 that is to be coated travels in the direction indicated by arrow A over a back-up roll 2. A doctor batten 6 slides between parallel slide faces 4 and 5 in a rigid doctor bed 3. Doctor batten 6 has a face 7 that is forced against coated web 1 and has a sharp stripping edge 8. An inflatable means of exerting contact pressure, in the form of a hose 9 between doctor bed 3 and doctor batten 6, allows the batten to be forced against the web 1 being coated to an extent that can be finely adjusted.

Figure 2:
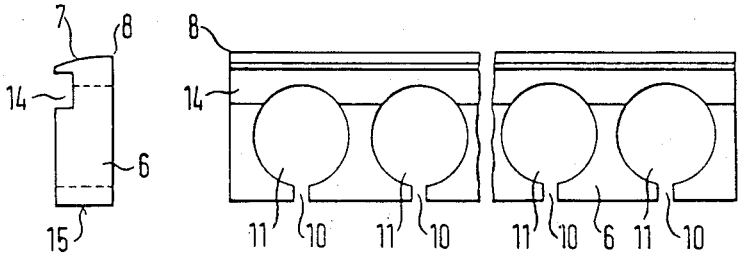
FIG. 2 is a side and bottom view of a doctor batten for the device in FIG. 1, FIGS. 3 and 4 are side views of other embodiments of the doctor batten.

The doctor batten 6 can be freely displaced along the slide face 4 of doctor bed 3 around two axes within selectable limits, meaning that it can be unimpededly extended. Doctor batten 6 has a relatively low moment I, preferably ranging from 200 to 7000 $mm^4$, of surface inertia in the vicinity of face 7 and stripping edge 8 along an axis perpendicular to stripping edge 8 and parallel to the web 1 being coated. Such a moment of surface inertia can be obtained for example with equidistant incisions 10 and recesses 11 along doctor batten 6, as illustrated in FIG. 2, with the cross-section of the batten remaining constant as measured over its total length up to a slight distance from stripping edge 8. The resulting flexibility of doctor batten 6 can alternatively be obtained by selecting an appropriate material to make it out of or by making it less thick.

The face 7 of doctor batten 6 extends more or less tangentially to coated web 1 at stripping edge 8. In the preferred embodiments illustrated, face 7 has a curve with a radius R of curvature such that 4 mm≦R≦09 preferably 5 mm≦R≦250 mm, and even more preferably 20 mm≦R≦50 mm at least in the vicinity of stripping edge 8. The radius R actually selected will depend on the desired range of coating weight and the rheological properties of the coating medium.

The surface of doctor batten 6 also has a Vickers hardness of more than 600 HV, at least in the vicinity of curved face 7 to keep the face resistant to wear. The face 7 of doctor batten 6 can be chromed, surface- or insert-hardened, spray-coated with oxide ceramics, anodized, or, if aluminum, hard coated or solid nickled for this purpose.

The stripping edge 8 of doctor batten 6 is absolutely straight and sharp, resulting in a coating that has extraordinarily satisfactory smoothness. Stripping can be further improved by relief-grinding stripping edge 8 at point 12 for example.

Figure 3:
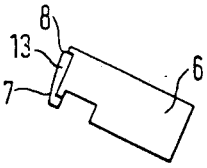
Figure 4:
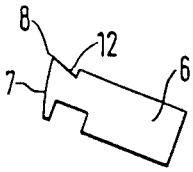

Another means of improving the wear resistance of the face 7 of doctor batten 6 is by making it out of a highly resistant inlay 13 as illustrated in FIG. 3.

To prevent the coating material from penetrating into the slide region between doctor bed 3 and doctor batten 6 or to reduce such penetration to a minimum, the bottom of doctor batten 6 has a longitudinal recess 14 that constitutes a labyrinth seal with respect to doctor bed 3 in the vicinity of face 7. This design simultaneously limits the displacement of doctor batten 6 in relation to doctor bed 3.

The geometry of the face 7 of doctor batten 6 is always constant in the embodiment being described no matter what the contact pressure. Since contact pressure is a significant parameter (in addition to the design of face 7, to the length of radius R, to web speed, to the rheology of the coating medium, and to the physical properties of the web), the quality of the coating can be kept absolutely constant at various contact pressures.

The inflatable means of exerting contact pressure employed in the embodiment being described is a contact-pressure hose 9 charged with air. The flexibility of the hose 9 ensures uniform compression of doctor batten 6 against the web 1 traveling over back-up roll 2 over the total operating width. The linear pressure exerted by the hose maintains equilibrium with the hydrodynamic pressure below the face 7 of doctor batten 6 in the wedge-shaped gap. Varying the pressure in the hose will accordingly result in extremely fine, uniform, and continuous adjustment of coating weight, with the same equilibrium between hydrodynamic pressure and doctor-contact pressure occurring at every point along the operating width without any additional contouring mechanism. This is the premise for a uniform coating depth. Contact-pressure hose 9 is designed in such a way that its forces will apply only to the rear surface 15 of doctor batten 6 and to a sealing insert 16 that is essentially parallel to surface 15 in doctor bed 3.

Doctor batten 6 and contact-pressure hose 9 can also be in one piece, although it must be ensured that the resulting unit is flexible enough and that face 7 is sufficiently wear-resistant.

The selection of pairs of materials for doctor bed 3 and doctor batten 6 must be made in such a way that the forces of friction that occur during the displacement of doctor batten 6 and that could counteract the contact pressure exerted by hose 9 and thus lead to hysteresis in controlling coating weight be kept as low as possible. Unavoidable shearing strains in preliminary coating-material flow-regulating gap 23 generate normal forces on doctor batten 6 with which the air pressure in hose 9 maintains equilibrium. If the coefficient $\mu$ of friction between doctor batten 6 and doctor bed 3 or feeding bar 26 is less than or equal to 0.1, the resulting forces of friction will be negligible in relation to the force of contact pressure.

Pairs of materials for doctor bed 3 and doctor batten 6 can be selected to attain the desired coefficient $\mu$ of friction. Doctor bed 3, at least in the vicinity of the slide faces, can be made out of steel or coated aluminum and doctor batten 6, at least in the vicinity of the slide faces, can be made out of gunmetal, coated with Teflon polytetrafluoroethylene or solid nickel, or hard-anode oxidized.

When a web 1 is to be coated on both sides,instead of a back-up roll 2 a second doctor batten 6 is positioned in relation to the first doctor batten 6 such that the faces 7 of each doctor batten 6 oppose each other and the stripping edges 8 of each batten 6 contact web 1 at the same level.

The doctor bed 3 of the doctor batten illustrated in the doctor mount in FIGS. 5 and 6 has a feeding bar 26 with a flat slide face 4 that accepts doctor batten 6 and controls its slide.

An inflatable means of exerting sealing pressure in the form of a sealing-pressure hose 28 is positioned between doctor bed 3 and one upstream surface 27 of the doctor batten 6, sealing the bed off from the batten and maintaining the stable position of the batten obtained by increasing the pressure. Sealing-pressure hose 28 presses against the surface 27 of doctor batten 6 and can, when pressure is high enough, retain the batten in a stable position once that position has been achieved. Since a relatively narrow doctor batten 6 is also employed, there is an additional spacer 29 that permits the narrow batten to be replaced with a wider one.

FIGS. 6 and 7 illustrate other doctor battens 6 with a longitudinal slot 30 opening toward web 1 and with an inlay 31 that snaps into the open end and constitutes the face. This type of doctor batten can also be longitudinally divided into several individually movable retaining blocks 32 as illustrated in FIG. 7.

The embodiment illustrated in FIG. 6 has supplementary means of exerting contact pressure positioned behind initial contact-pressure hose 9 to locally elevate pressure and compensate for irregular uptake of coating material by web 1. These means are set screws 34 that engage a sheet-steel backing 33 in doctor bed 3.

Finally, the embodiment illustrated in FIG. 6 has means of partly forcing doctor batten 3 down to facilitate removing any (granular) contamination between the doctor batten and the web that could make lines, especially continuous, on the web. These means are keys 36 that can be inserted into doctor bed 3 and engage a lateral continuation 35 of doctor batten 6. When keys 36 are turned, they force doctor batten 6 down.

It is understood that the specification and examples are illustrative but not limitative of the present invention and that other embodiments within the spirit and scope of the invention will suggest themselves to those skilled in the art.

I claim:

1. In a device for coating a continuous web with regulable coating including a rotatable roll at the uncoated side of the web acting as a counter-pressure element, a doctor rod that rests against the coated side of the web, in a doctor bed carrying the doctor rod, and means for elastically forcing the rod against the web being coated and the web against the roll, the improvement wherein (a) the doctor bed is rigid and has at least one flat overflow-side slide face and the doctor rod is a doctor batten is movably mounted in the doctor bed with little friction along the at least one overflow-side slide face of the doctor bed, (b) the doctor batten has a rectangular face adjacent the web that is being coated and including an upper edge, which face in conjunction with the web defines a narrowing coating-material application gap with a geometry that depends on the degree of contact pressure, (c) the upper edge of the face constitutes a straight and sharp stripping edge, (d) the face and stripping edge of the doctor batten are flexible, (e) the face is highly resistant to wear, (f) the contact pressure is exerted by an elastic means of exerting pressure positioned between the batten and the bed.

2. A device according to claim 1, wherein the doctor batten can travel with low friction between parallel slide faces on the doctor bed.

3. A device according to claim 1, wherein the coefficient of friction between the doctor batten and bed is about $\mu \leqq 0.1$.

4. A device according to claim 1, wherein the face of the docter batten extends at the stripping edge at more or less of a tangent to the coated web and curves convexly as it extends from the stripping edge at least in the vicinity of that edge with a radius such that 4 $mm \leqq R \leqq \infty$.

5. A device according to claim 4, wherein the face is facet ground to approximately the radius of curvature.

6. A device according to claim 1, wherein the face is between about 8 mm and 60 mm wide.

7. A device according to claim 1, including a spacer positioned between the upstream surface of the doctor batten and the bed .

8. A device according to claim 1, wherein the stripping edge of the doctor batten is relief ground.

9. A device according to claim 1, wherein the doctor batten has a moment of inertia I in the vicinity of the face and the stripping edge in relation to an axis perpendicular to the edge and parallel to the web being coated such that $200\ mm^4 \leqq I \leqq 7000\ mm^4$.

10. A device according to claim 1, wherein the doctor batten has equidistant incisions along its length.

11. A device according to claim 1, wherein the doctor batten is made of polytetrafluoroethylene.

12. A device according to claim 1, wherein the doctor batten is made of a rubber-elastic material.

13. A device according to claim 1, wherein the the Vickers hardness of the face of the doctor batten is greater than 600 HV.

14. A device according to claim 1, wherein the face of the doctor batten is one of chromed, surface-hardened, insert-hardened, spray-coated with an oxide ceramic, anodized, hard coated and solid nickled aluminum.

15. A device according to claim 1, wherein the face of the doctor batten is an inlay with high wear resistance.

16. A device according to claim 1, wherein the bottom of the doctor batten has a longitudinal recess in the vicinity of the face, forming a labyrinth seal for the doctor holder.

17. A device according to claim 1, wherein the elastic means of exerting contact pressure comprises an inflatable hose operating between a surface of the doctor batten that is essentially perpendicular to the overflow-side slide face of the doctor bed and another surface of the batten that is essentially parallel to the first surface.

18. A device according to claim 1, including an inflatable means of exerting sealing pressure positioned between the upstream surface of the doctor batten and the doctor bed.

19. A device according to claim 18, wherein the inflatable means of exerting pressure is a sealing-pressure hose.

20. A device according to claim 1, wherein said backup roll has a rubber-elastic surface with a hardness between about 60 and 95 Shore A.

21. A device according to claim 1, including keys that can be inserted into the doctor bed and engage a lateral continuation of the doctor batten, thereby partly forcing the doctor batten down.

22. A device according to claim 1, wherein the doctor batten has equidistant recesses along its length.

* * * * *